United States Patent [19]

Diamond et al.

[11] Patent Number: 4,667,601

[45] **Date of Patent: * May 26, 1987**

[54] LAUNCHABLE AEROSOL GRENADE

[75] Inventors: George B. Diamond, Anthony & Woodglen Rds., Glen Gardner, N.J. 08826; Ralph H. Helmrich, Glen Gardner, N.J.

[73] Assignee: George B. Diamond, Glen Gardner, N.J.

[ * ] Notice: The portion of the term of this patent subsequent to Dec. 9, 2003 has been disclaimed.

[21] Appl. No.: 770,501

[22] Filed: Aug. 28, 1985

Related U.S. Application Data

[63] Continuation-in-part of Ser. No. 649,982, Sep. 13, 1984, Pat. No. 4,627,354.

[51] Int. Cl.[4] ..... F42B 13/44; F42B 13/48

[52] U.S. Cl. ..... 102/368; 102/334; 102/370; 102/502

[58] Field of Search ..... 102/293, 334, 367, 368, 102/369, 370, 395, 502, 512, 513, 529; 42/1 F

[56] References Cited

U.S. PATENT DOCUMENTS

| | | | |
|---|---|---|---|
| 1,357,927 | 11/1920 | Clarke | 102/513 X |
| 1,632,147 | 6/1927 | Ragsdale | 102/395 |
| 1,779,617 | 10/1930 | Pauola | 102/369 |
| 1,819,415 | 8/1931 | Harris | 102/512 |
| 2,617,359 | 11/1952 | Van Horn et al. | 102/512 |
| 3,683,815 | 8/1972 | Shaffer | 102/368 |
| 3,685,450 | 8/1972 | Walbeck et al. | 102/334 |
| 3,831,520 | 8/1974 | Bowen et al. | 102/369 |
| 4,044,684 | 8/1977 | Gaggini et al. | 102/370 |
| 4,109,579 | 8/1978 | Carter | 102/529 X |
| 4,195,572 | 4/1980 | Knapp | 102/293 X |

FOREIGN PATENT DOCUMENTS

| | | | |
|---|---|---|---|
| 2033554 | 5/1980 | United Kingdom | 102/512 |

*Primary Examiner*—David H. Brown

*Attorney, Agent, or Firm*—Ostrolenk, Faber, Gerb & Soffen

[57] ABSTRACT

A projectile for delivering to a target a can containing pressurized material which is to be dispersed over the area of target. In one embodiment, the projectile includes a cylindrical hollow housing to the rear end of which is attached a launching tube with a fin assembly. The can is slidably disposed within the housing. There is a space between a cap which closes the forward end of the housing and the can in the housing. The can slides forward in the housing toward the cap upon impact of the cap against the target. This opens a valve which releases the contents of the sealed can into the housing, and this, in turn, blows the cap off the housing so that the released material is dispersed over the target area. In another embodiment, the can itself has the launching tube and fin assembly attached to its bottom. Instead of being enclosed in a housing, the top of the can carries a cap which closes the top of the can and which cap is detented spaced away from the dispensing nozzle. The detented cooperation between the cap and the can permits the cap to collapse against the dispensing nozzle upon impact of the cap against the target, and this activates the nozzle for release of the material inside the cap. With both embodiments, upon release of the material inside the cap, the cap or housing is blown off, enabling dispersion of the material in the can. With the present projectile, the sealed can is not breached before the projectile strikes its target and the contents of the can may be dispersed in a short time.

14 Claims, 10 Drawing Figures

LAUNCHABLE AEROSOL GRENADE

CROSS-REFERENCE TO RELATED APPLICATION

This is a continuation-in-part of Ser. No. 649,982, filed Sept. 13, 1984, now U.S. Pat. No. 4,627,354.

BACKGROUND OF THE INVENTION

The present invention relates to a projectile suitable for delivering a quantity of pressurized material, and particularly, to an aerosol grenade which is adapted to be launched, from a gun or similar device, and which does not begin releasing the pressurized material until impact of the projectile.

Some gaseous materials must be released at a location away from the party who wants to release them for effective use of these materials and for protection of the party releasing them. For example, law enforcement personnel may use tear gas or similar disabling agents to control crowds and to dislodge barricaded persons and those personnel wish to be able to disperse the tear gas over a target area which they are away from. The law enforcement personnel who use such disabling agents should be protected from accidental discharge. Furthermore, it must be assured that a person at whom a tear gas grenade is targeted is not able to capture the still active tear gas grenade and throw it back.

In the prior art, dispersable materials, e.g. tear gas, were dispersed by various techniques. In one technique, the dispersable material was combined with a flammable material. Burning the combined materials vaporized them and they thereafter spread as a smoke cloud. In another technique, the dispersable material is packed with an explosive charge which detonates upon impact and causes the dispersable material to spread over an area.

The major shortcomings of these prior art techniques is that the combustion or explosion associated with each technique poses a fire or concussion hazard to buildings, property and people. A container with slow burning contents can be picked up and thrown back at law enforcement personnel. An exploding projectile can cause injury. If a projectile does not explode upon impact, it poses a danger to innocent bystanders or police personnel who attempt to retrieve it.

U.S. Pat. No. 4,195,572 discloses a projectile which is filled with a dispersable material and which is suitable for launching by a gun. The material is stored in a pressurized can in a housing. The rear or bottom end of the housing, which is the end toward the user, carries a piercing pin. The can is slidably mounted in the housing and is spaced away from the pin. As the projectile is launched, the inertia of the can impacts it against the piercing pin and the bottom of the can is punctured. The later impact of the front of the projectile hitting a target releases the can from the piercing pin and the pressurized contents of the can are discharged through its pierced bottom and pass out through holes in the hollow housing.

In the above described projectile device, the pressurized container is pierced before the projectile reaches its destination, i.e. at launch. This poses the danger that the contained material may be released before impact of the projectile. Further still, the punctured can could explode at launch or disperse material over the person firing the projectile. Furthermore, the device of the 4,195,572 patent, as well as other prior devices, releases the pressurized material slowly, so that the can could be picked up and hurled back at law enforcement personnel.

SUMMARY OF THE INVENTION

It is an object of the present invention to provide a non-flammable and non-explosive projectile for delivering pressurized material which is to be dispersed at a target area.

It is another object of the invention to provide a launchable projectile in which the can holding the dispersable material remains intact prior to reaching the target.

It is still another object of the invention to provide a launchabale pressurized can for rapidly releasing tear gas, or the like, upon impact of a projectile containing the can.

A further object of the invention is to prevent that can from being able to be picked up by anyone in the target area before the pressurized contents have been dispensed.

Yet another object of the invention is to provide such a projectile which includes a minimum of elements supported to or attached to the can containing the pressurized material.

The foregoing and other objects are realized with a non-flammable, non-explosive projectile including a sealed can containing dispersable material, which can is breached for commencing release of its contents only after the projectile has impacted at its intended target.

In one embodiment, the projectile includes a hollow housing. A launching tube extends rearward from the bottom or rear of the housing. A fin assembly around the launching tube regulates the flight of the projectile to assure that the housing section leads the launching tube. The sealed pressurized can has a cross-section such that it fits inside the hollow housing, so that some predetermined force is required to cuase the can to slide through the housing. The can is initially positioned toward the rear and bottom of the housing. The length of the can is so selected that a free space remains between the can and the top of the housing. The top surface of the can which faces the top of the housing is provided with an exit mechanism for the material to be dispersed.

The top of the housing is covered by a cap which holds the can in the housing. The cap is intended to pop off after impact. For example, the cap is friction fitted over the top of the housing. An actuating mechanism, disposed in the space between the top of the can and the cap of the housing, operates the exit mechanism of the can. This may simply be a pin to pierce the can or an operator for a release valve in the can.

Upon being launched, the projectile is oriented through the action of the fin assembly such that the intended target will be struck by the cap of the projectile. Upon impact, in the first embodiment, the sealed can inside is slid under inertial force toward the cap of the housing causing interaction of the exit and actuating means for allowing the contents to violently exit the can and forcefully fill the space between the can and the cap cover. As sufficient pressure develops in this space, the cap, which is only frictionally held over the top of the housing, is popped off and the gaseous contents of the can exit the can and the housing and are immediately dispersed over the target area.

In an alternate embodiment, no housing is used. Instead, the pressurized can containing the contents to be dispensed has the projectile launching tube affixed directly beneath it. The top of the can itself carries a cap that is intended to pop off after impact, as in the previous embodiment. In this embodiment, the cap is spaced away from the exit means from the can sufficiently to prevent premature dispensing from the can. A detent means holds the cap at the appropriate height over the exit means. The various detent means that might be provided share the characteristics that they hold the cap above the outlet end of the can a sufficient distance to prevent premature dispensing from the can, that they are sufficiently resistant to inertial forces upon launching of the projectile to prevent the cap from being urged rearwardly over the can to where it would prematurely cause dispensing, but the detent means is sufficiently weak that impact of the cap upon the target, is sufficient to override the detent means, enabling the cap to be pushed down over the end of the can to actuate the exit means from the can. Various overridable detent arrangements are described in detail below and alternatives thereto can be envisioned by ones skilled in the art.

Upon impact, in the second embodiment, the cap is forced down past the detent means over the outlet end of the can for causing interaction of the exit means of the can and actuating means of the cap which allows the contents to violently exit the can and forcefully fill the space between the can and the cap. As sufficient pressure develops in the space, again, the cap, which is still only frictionally held over the end of the can, is popped off, as in the first embodiment.

A larger opening in the exit mechanism permits the contents of the can to be evacuated so rapidly that if someone in the target area were to pick up the projectile for the purposes of throwing it away or hurling it at law enforcement officials, its contents would already have been dispersed. Further, when the cap is popped off under pressure following impact, this pops the projectile up off the ground, making it more difficult to be picked up before all of the can contents have exited. Additionally, because the pressurized contents of the can are released effectively all at once, the dispersable material is able to spread over a larger area. Also, since the projectile pops up while it discharges, much of the can contents are dispersed at head and face level wherein it is much more effective than at ground level.

There may be any of several actuating mechanisms in the form of means for piercing the sealed can upon impact. In one embodiment, the top surface area of the can which faces forward toward the top of the housing is provided with a frangible covering. The cap of the housing carries a piercing pin which extends rearward into the housing toward the frangible cover of the can. Upon impact, the can slides towards the cap of the housing and the piercing pin shatters the frangible cover.

In an alternate embodiment, the can has a large exit opening fitted with a one-shot valve which remains sealed prior to the impact of the projectile. Detenting protrusions ensure that, once it is opened upon impact, the valve remains open. As the projectile strikes the target, the can in the housing slides forward and the valve operating tube of the valve impacts against the cap of the housing which opens the valve. The valve operating tube may be sufficiently elongate to contact the cap itself, or an actuating pin extending down from the cap may actuate the valve.

In a particular embodiment, the fins of the fin assembly may be folded around the launch tube of the projectile to allow the projectile to be launched directly from a barrel of a gun.

Other features and advantages of the invention will be apparent from the following description of preferred embodiments of the invention considered with reference to the accompanying drawings.

DETAILED DESCRIPTION OF PREFERRED EMBODIMENTS

Figure 1:
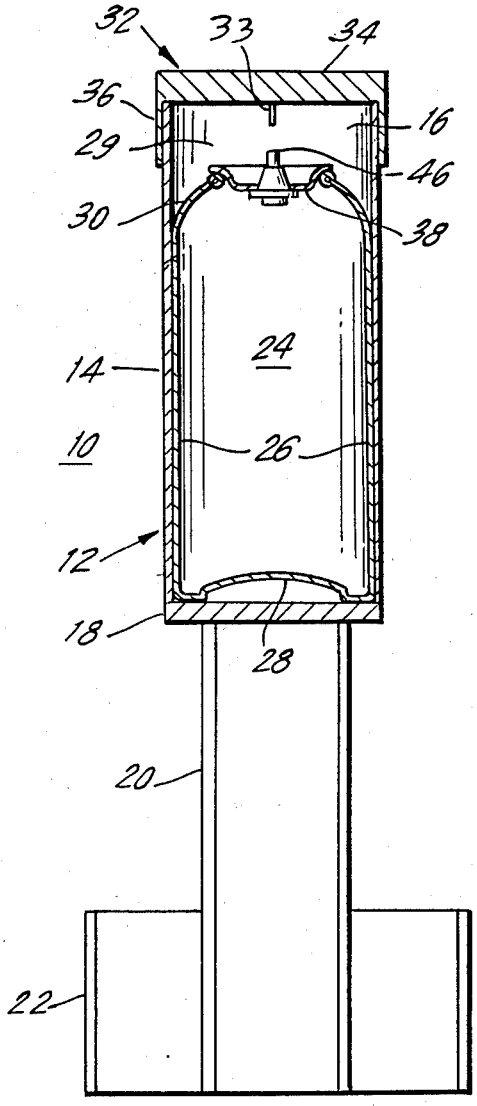
FIG. 1 is a cross-sectional, elevational view showing a projectile according to a first preferred embodiment of the invention before impact of the projectile.
Figure 2:
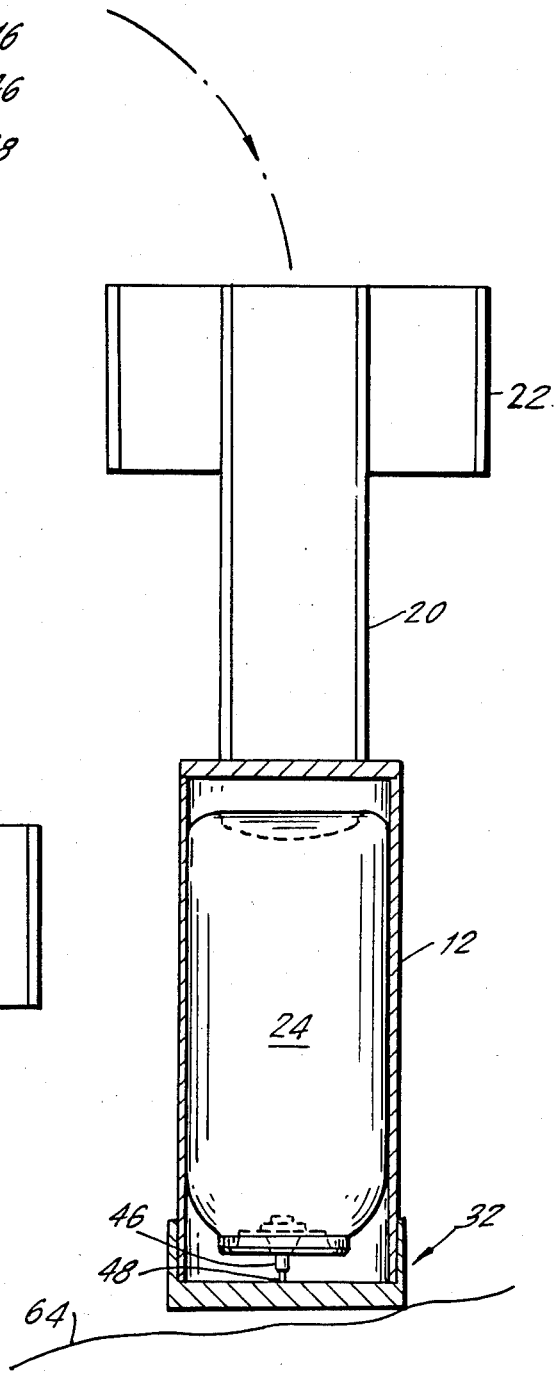
FIG. 2 shows the projectile of FIG. 1 after it impacts its intended target.

Referring to FIG. 1, the projectile 10 according to the first embodiment of the invention includes a hollow cylindrical housing 12 defined by annular peripheral side wall 14, an open top 16 and a closed bottom 18. A launch tube 20 it fixed to and projects from the bottom 18 of the housing. The launch tube 20 is preferably a cylindrical elongate shaft which is dimensioned so that the projectile can be launched by a spigot launcher (not shown) from a gun barrel. The launch tube 20 is fitted with a fin assembly 22 at its end away from the housing 12. The fin assembly ensures that the projectile may fly accurately and over a greater distance and that the projectile strikes the target front end first.

A sealed pressurized can 24 containing the material which is to be dispersed over a target area is inserted into the housing 12 as shown in FIG. 1. The can 24 comprises a cylindrical body, defined by a cylindrical peripheral side wall 26 and a closed bottom 28. The outer cross-sectional shape and dimension of the can 24 are such that it friction fits into the housing 12 of the projectile after it is installed through the open top 16. The can 24 is initially positioned rearwardly to the bottom of the housing where it is retained by the very light friction fit between the can side wall 26 and the peripheral side wall 14 of the housing. The axial length of the can 24 is shorter than the axial length of the housing 12 so that an open space 29 remains between the top surface 30 of the can and the open top 16 of the housing.

With the can 24 in the housing 12, the open top 16 of the housing is covered by a cap 32. The cap 32 comprises a flat top 34 surrounded by a peripheral skirt 36. The skirt of the cap tightly friction fits over the open top 16 of the housing 12.

Two mechanisms for releasing materials from the can 24 when the projectile 10 strikes its target are now described with reference to FIGS. 1, 3 and 4. The side wall 26 of the can 24 defines an upper opening 38 which is sealed by an upper closure 40 which fits over the chime 42 of the upper opening 38. There is a discharge opening 44 centrally located in the closure 40.

Figure 3:
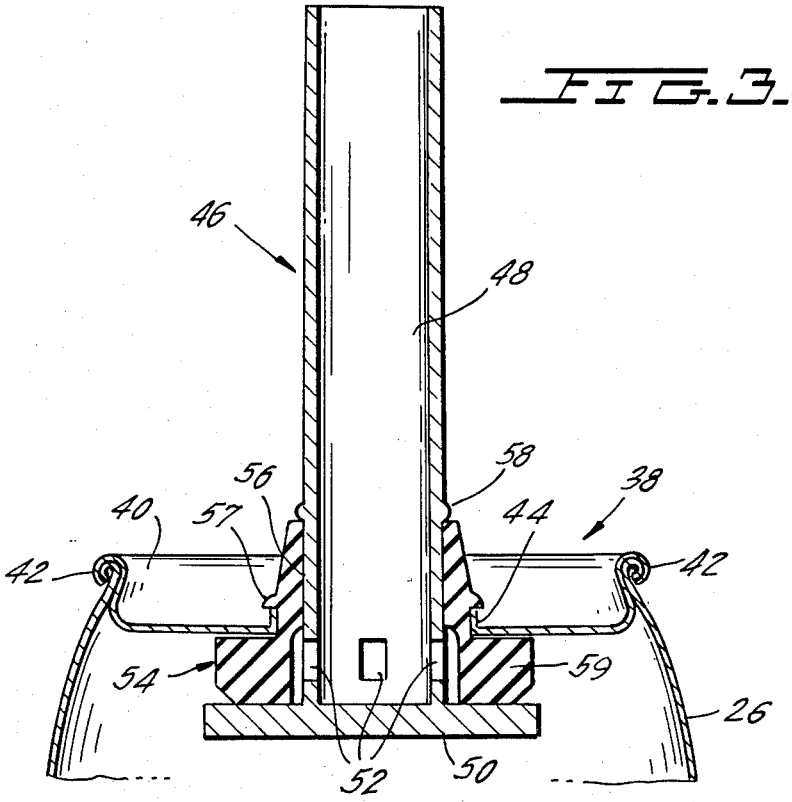
FIGS. 3 and 4 show preferred embodiments of means for opening the can upon impact.

In the embodiment of FIG. 3, a valve 46 closes the discharge opening 44. The valve comprises an elongate hollow tube 48 with a disc bottom 50 which closes off the lower end of the tube 48 and which has a surface area which is larger than the area bounded by the discharge opening 44. The hollow tube 48 includes perforations 52 adjacent its bottom 50 which provide a passageway from the can into the hollow tube 48. An elastic sealing gasket 54 of rubber, which does not change in character in the presence of the can contents or affect the can contents, and having a central opening 56, is fitted in the discharge opening 44 of the upper closure 40 of the can. The annular detent projection 57 cooperates with the thickened base 59 of the seal to hold it in the opening 44. The valve tube 48 is slidably friction fitted in the central opening 56 of the seal 54. As presently positioned, the base 59 of the seal 54 surrounds and covers up the perforations 52 of the valve tube 48. The bottom 50 of the valve is pressed against the seal base 59 by the internal pressure in the can. The valve tube 48 is also provided with locking projections 58 for locking the valve open, as described below.

The valve 46 shown in FIG. 3 is referred to as a "one-shot" valve, which remains in its open position once actuated. As the tube 48 is pushed into the can 24 upon impact of the projectile, the projections 58 will be locked below the base of the elastic seal 54 and the valve tube 48 will be prevented from returning to its original position. In the open position, the perforations 52 of the valve are no longer closed by the elastic seal 54 and the contents of the can are allowed to enter the perforations 52 and exit through the inner hollow passage of the tube 48.

In operation, upon impact between the projectile and an object 64, intertial force will slide the can away from the closed bottom 18 of the housing 12 toward the cap 32. In particular, valve 2 strikes the projection 33 inside the cap 32. The valve tube 48 is sufficiently long so that the valve tube strikes the cap 32. This movement of the can will open the valve 46 and allow the contents of the can 24 to escape into the housing 12 of the projectile 10. The pressure than separates the cap 32 from the housing 12. Thereafter, the pressurized contents of the can 24 are immediately dispersed over the target area due to the large opening of the valve 46 and the highly pressurized contents of the can.

Figure 4:
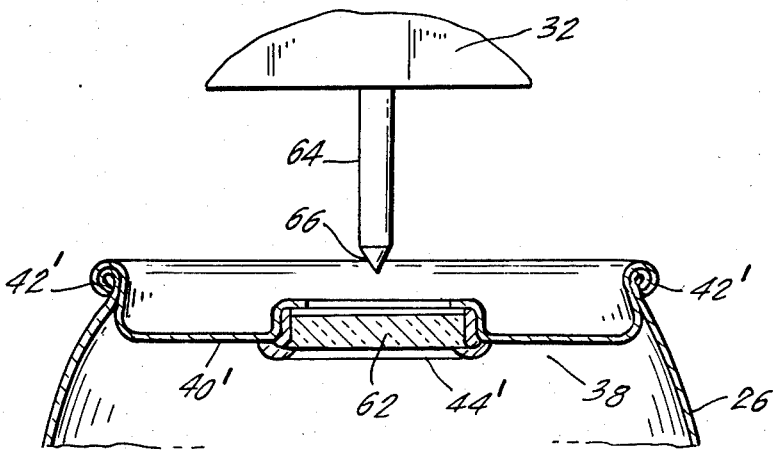

Another valve mechanism is shown in FIG. 4. The discharge opening 44' of the closure 40' is covered by a frangible disk 62. The clsoure 40' extends to and fits over the chime 42' which surrounds the opening in the container. A piercing pin 64 is fixed to the cap 32 at one end, and the other end of the pin provided with a sharp edge 66. Upon impact, the can 24 slides forward and the frangible disk 62 is shattered by the piercing pin 64. Thereafter, the contents of the can 24 escape and are dispersed as described above.

Figure 5:
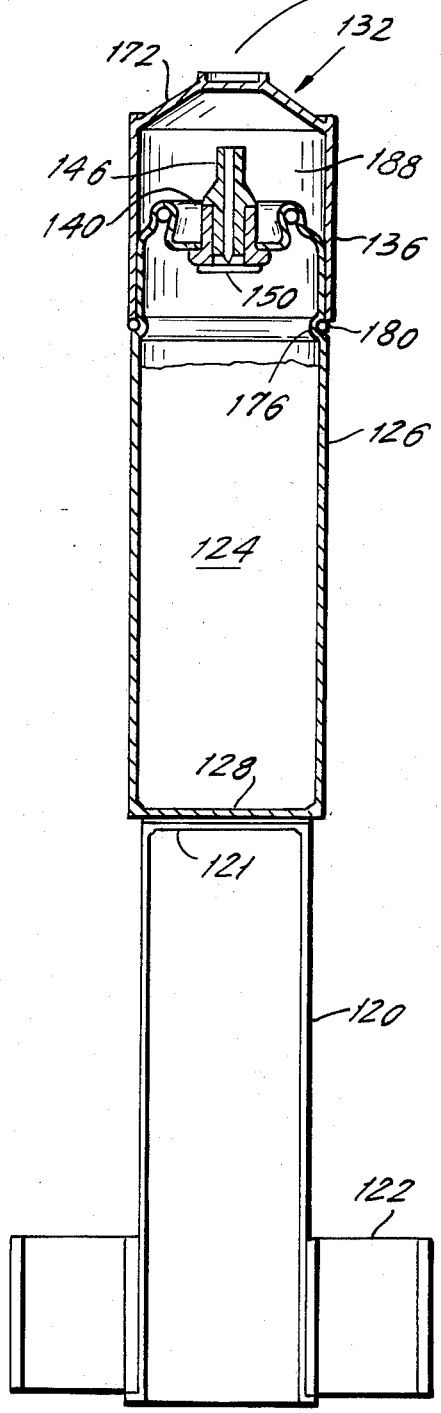
FIG. 5 is a cross-sectional, elevational view showing a projectile according to a second preferred embodiment of the invention before impact of the projectile.
Figure 6:
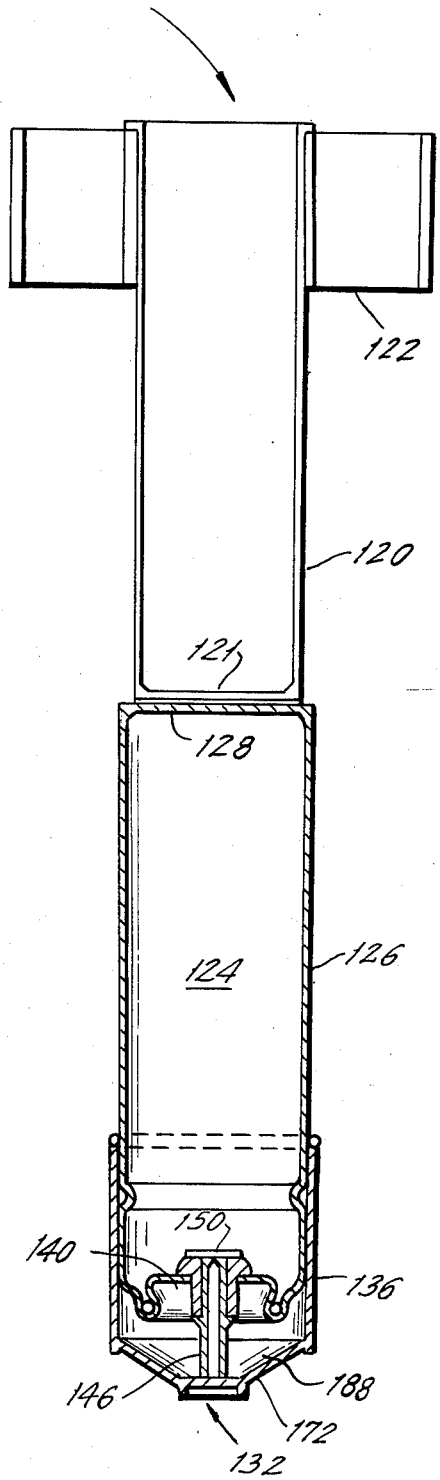
FIG. 6 shows the projectile of FIG. 5 after impact.

The second preferred embodiment of the projectile shown in FIG. 5 shares a number of features in common with the first embodiment shown in FIG. 1. Rather than repeating a description of every element appearing in FIG. 1, the corresponding elements in FIG. 5 to those shown in FIG. 1 will be correspondingly numbered with reference numerals raised by 100, and only those features of the second preferred embodiment which are different significantly from those in the first embodiment are described.

In the second embodiment, the bottom end 128 of the can is directly bonded by adhesive or by a weld joint or other means to the forward end 121 of the launch tube 120. Obviously, upon impact, the can 124 does not shift with respect to the launch tube. Instead, the can 132 is driven down over the top of the can and toward the valve 146 by the impact of the top 172 of the cap 132.

The cap 132 includes the elongate peripheral skirt 136 which is sized to have an overridable friction fit over the external wall 126 of the can 124. The cap 132 is detented in the upraised condition over the end of the housing. This detenting is strong enough to prevent the cap from being prematurely moved down over the stem of the valve 146 due to inertia during a launch. However, the detent means is weak enough that it permits the cap to be slid down over the can when the projectile impacts against the target, cap first.

Figure 7:
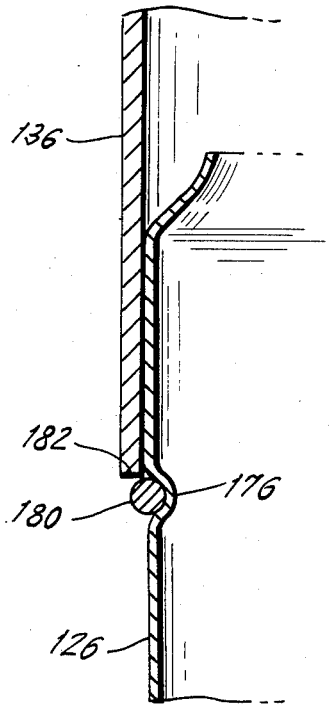
FIG. 7 shows an enlarged fragment of the projectile of FIG. 5 to illustrate the detent means thereof.

With reference to FIG. 7, one form of detent means comprises a peripheral depressed groove 176 that is conventionally rolled into the side wall 126 of the conventional aerosol can 124. A resilient O-ring 180 sized to the circumference of the groove 176 is fitted over the end of the can and slid along the can into the groove. The O-ring 180 is sufficiently resilient that when sufficient force is applied to the side of the O-ring, it expands and is forced out of the groove. The bottom edge 182 of the skirt 136 of the cap normally rests on the O-ring 180, as shown in FIG. 7. The O-ring 180 is sufficiently stiff that upon launch of the projectile, the inertia of the cap is not sufficient to push the O-ring 180 out of the groove 176. However, upon impact of the cap 136 against the target, there is sufficient force exerted by the bottom edge 182 of the cap against the O-ring 180 to stretch the O-ring and snap it out of the groove 176, and the O-ring is then slid down the side wall of the can as the cap descends along the side of the can. Eventually, the top wall 172 of the cap 132 presses upon the valve stem 146, which may be of the type shown in FIG. 3. This releases the valve to fill the space 188 beneath the cap and above the top of the can with the pressurized material. As in the previous embodiment, when the pressure beneath the cap 132 is sufficient, the cap pops off the can, releasing the material beneath the cap and also throwing the aerosol can and projectile into the air for better distribution of the pressurized material and also preventing persons from picking up the projectile until the contents of the can have been largely or completely expelled.

Figure 8:
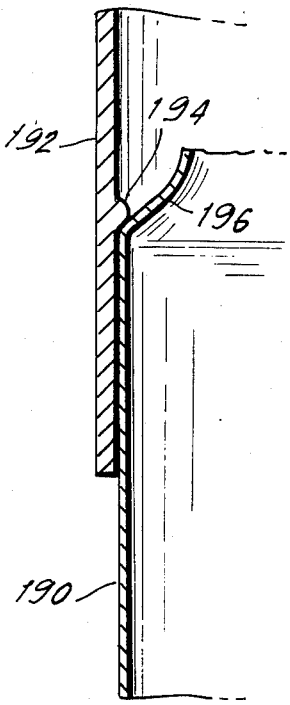
FIG. 8 is a detail of an alternate detent arrangement from that shown in FIG. 7.

The alternate detent arrangement shown in FIG. 8 operates similarly to that shown in FIG. 7. In this case, the can side wall 190 is smooth and need not have a groove defined in it. The skirt 192 of the cap has a small molded protrusion 194 defined in it, which may be annular, or may be a single protrusion occupying a short arcuate length, or may be a series of protrusions, etc. The protrusion 194 is so placed that it will rest upon the neck 196 of the can just above the side wall 190. The protrusion 194 is strong enough to resist the inertia of the cap during launch of the projectile. However, upon impact of the projectile against the target, the force exerted on the cap will shear off the protrusion 194 and permit the cap to descend.

Figure 9:
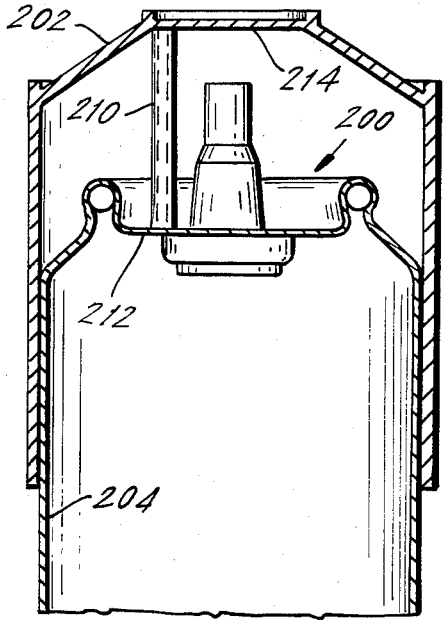
FIG. 9 shows an alternate means for supporting the cap over the can of the projectile of FIG. 5.

The further alternative shown in FIG. 9 does not use a detent between the cap 202 and the side wall 204 of the can 200. Instead, a crushable member 210 extends between the top 212 of the can and the underside of the top 214 of the cap 202. The crushable member is stiff enough to resist the inertial force on the cap during launch, but the crushable member will crush on impact of the cap 202 against the target. Once that member 210 is crushed, the cap 202 operates the valve in the same way as in the previous embodiments. The choice of crushable members is virtually limitless, from a thin stick of wood, to a strip of metal or plastic material or crumpled material, etc. Instead of a crushable member as shown in FIG. 9, a crushable tube could surround the valve stem.

Figure 10:
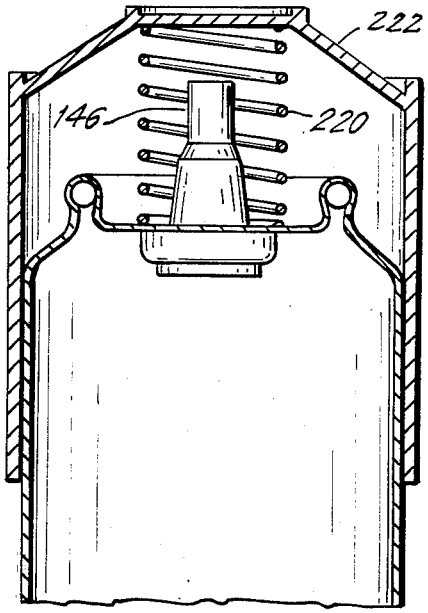
FIG. 10 shows an alternative technique to that shown in FIG. 9 for holding the cap off the end of the can.

In the alternate embodiment shown in FIG. 10, the spring 220 surrounds the valve stem and is used in place of the crushable member to act in the same manner. The spring normally biases the cap 222 off the valve stem 146 until the impact of the cap against the target, which is sufficient to override the biasing force of the spring and operate the valve to open. Since the valve may be of the type shown in FIG. 3, which is a "one-shot" valve, that the spring may raise the cap agsin after impact does not adversely affect the operation of the projectile, since the valve is permanently opened and will continue to expel the contents of the can. Other arrangements can be envisioned by one skilled in the art for holding the cap off the valve until impact of the cap against the target.

Although the present invention has been described in connection with preferred embodiments, many variations and modifications will now be apparent to those skilled in the art. It is preferred, therefore, that the present invention be limited not by the specific disclosure herein, but only by the appended claims.

What is claimed is:

1. A projectile for delivering a quantity of pressurized material to a target agent and for dispersing the material at the target area, said projectile comprising:

a sealed can containing said quantity of pressurized material;

exit means from said can for allowing said pressurized material to exit from said can through said exit means;

a cap over said exit means including means for fitting said cap to said can in a manner which is effective for popping of said cap upon pressure increase within said cap; actuating means in said cap for actuating said exit means when said actuating means in said cap moves toward and contacts said exit means from said can; said cap being held to said can such that said actuating means is normally spaced away from said exit means;

means normally supporting said cap to hold said actuating means off said exit means; said supporting means, said actuating means, and said exit means being so placed that upon impact of said projectile and its said cap upon a target, said cap is moved with respect to said can such that said actuatng means contacts said exit means for allowing said pressurized material to exit from said can.

2. The projectile of claim 1, wherein said projectile has a front end ans a rear region, said cap being at said front end of said projectile and said cap being so placed that it is the part of said projectile which impacts upon a target.

3. The projectile of claim 1, wherein said exit means comprises a valve which normally seals said can closed and which is openable upon pressure against said valve, and said actuating means comprises a portion of said cap contacting said valve for opening said valve.

4. The projectile of claim 1, further comprising a launching tube secured at said rear region of said can and extending rearwardly therefrom.

5. The projectile of claim 1, wherein said supporting means comprises a deflectable support between said cap and said can for normally supporting said cap to raise said actuating means off said exit means, and said support being deflectable upon impact upon said cap against a target for collapsing sufficiently to permit said actuating means to move to said exit means.

6. The projectile of claim 5, wherein said support comprises a crushable element.

7. The projectile of claim 5, wherein said support comprises resilient biasing means for normally biasing said cap to raise said actuating means off said exit means.

8. The projectile of claim 5, wherein said exit means comprises a valve which is engaged and opened by said actuating means for permitting exit of material from said can, said valve including means for keeping said valve opened upon engagement between said valve and said actuating means therefor.

9. The projectile of claim 1, wherein said supporting means comprises detent means between said cap and said can for normally holding said cap so that said actuating means is normally off said exit means, and said detent means being overridable upon impact of said cap upon a target for permitting said cap to move such that said actuating means contacts said exit means.

10. The projectile of claim 9, wherein said detent means comprises a groove in said can, a resilient ring in and supported in said groove and being resilient so as to resist moving out of said groove, and said cap having a bottom edge which normally rests upon said ring and such that impact upon said cap drives said cap over said can and presses upon said resilient ring to move said ring out of said groove.

11. The projectile of claim 9, wherein said detent means comprises said can having a surface thereon and said cap having a protrusion inside it and normally resting upon said surface for supporting said cap to raise said actuating means off said exit means; said protrusion being overridable to permit said cap to move upon impact upon said cap to bring said actuating means to said exit means.

12. The projectile of claim 11, wherein said protrusion being overridable comprises said protrusion being breakable to break free of said cap.

13. The projectile for delivering a quantity of pressurized material to a target area and for dispersing said material at said target area, said projectile comprising:

a sealed can containing said pressurized material; exit means from said can for allowing said pressurized material to exit from said can;

an enclosure over said can and fitted thereto for enclosing said can around said exit means, said enclosure comprising a cap which closes said enclosure; actuating means in said cap for actuating said exit means when said cap shifts relatively with respect to said can for bringing said actuating means in said cap against said exit means of said can; said enclosure, which comprises said cap, and said can being sized to be relatively shiftable with respect to each other upon impact of said projectile cap against a target.

14. The projectile of claim 13, wherein said exit means comprises a valve which is engaged and opened by said actuating means for permitting exit of material from said can, said valve including means for keeping said valve opened upon engagement between said valve and said actuating means therefor.

* * * * *